US006027194A

United States Patent [19]

Fleisch

[11] Patent Number: 6,027,194

[45] Date of Patent: Feb. 22, 2000

[54] DEVICE FOR MOUNTING THE FRONT PANEL OF A DRAWER

[75] Inventor: Walter Fleisch, Lustenau, Austria

[73] Assignee: Alfit Aktiengesellschaft, Gotzis, Austria

[21] Appl. No.: 09/065,840

[22] Filed: Apr. 24, 1998

[30] Foreign Application Priority Data

Apr. 29, 1997 [AT] Austria ..... 741/97
Nov. 7, 1997 [AT] Austria ..... 1880/97

[51] Int. Cl.[7] ..... A47B 88/00

[52] U.S. Cl. ..... 312/348.4; 312/348.1; 403/325

[58] Field of Search ..... 312/348.4, 348.2, 312/348.1, 330.1, 265.5, 265.6; 403/321, 325, 245

[56] References Cited

U.S. PATENT DOCUMENTS

| | | | |
|---|---|---|---|
| 4,012,158 | 3/1977 | Harper | 403/325 X |
| 4,036,525 | 7/1977 | Howk | 403/325 X |
| 4,128,354 | 12/1978 | Amrogowicz | 312/265.5 X |
| 5,163,774 | 11/1992 | Lautenschlager | 403/245 |
| 5,222,791 | 6/1993 | Held et al. | 312/348.4 |

FOREIGN PATENT DOCUMENTS

| | | | |
|---|---|---|---|
| 391 253 | 3/1990 | Austria . | |
| 0 289 866 | 11/1988 | European Pat. Off. . | |
| 0 761 130 | 3/1997 | European Pat. Off. . | |
| 3801103 | 8/1988 | Germany | 312/348.4 |
| 3801816 | 8/1988 | Germany | 312/348.4 |
| 404183409 | 6/1992 | Japan | 312/348.4 |
| 2190831 | 12/1987 | United Kingdom | 312/348.4 |

*Primary Examiner*—Peter M. Cuomo
*Assistant Examiner*—Hanh V. Tran
*Attorney, Agent, or Firm*—Collard & Roe, PC

[57] ABSTRACT

A drawer comprises a lateral metallic frame, a front panel and a device for mounting the front panel on the lateral metallic frame. The mounting device comprises a holder provided at the front panel and protruding against the lateral metallic frame, and the holder comprises a guiding member engaging in a guiding slot of the frame, the guiding slot being open at an end face of the frame, extending in the longitudinal direction and forming a widened portion constituted by a frame recess extending transversely to the longitudinal direction. A locking piece is disposed at a side of the guiding member facing away from the front panel, the frame recess forming a locking stop engaged by a supporting surface of the locking piece, and a locking bar is insertable through the guiding slot into the widened portion laterally adjacent the frame, the locking bar being a carrier for the locking piece and being movable transversely to the guiding slot, and the locking bar being subject to a locking force.

14 Claims, 5 Drawing Sheets

Figure 3:
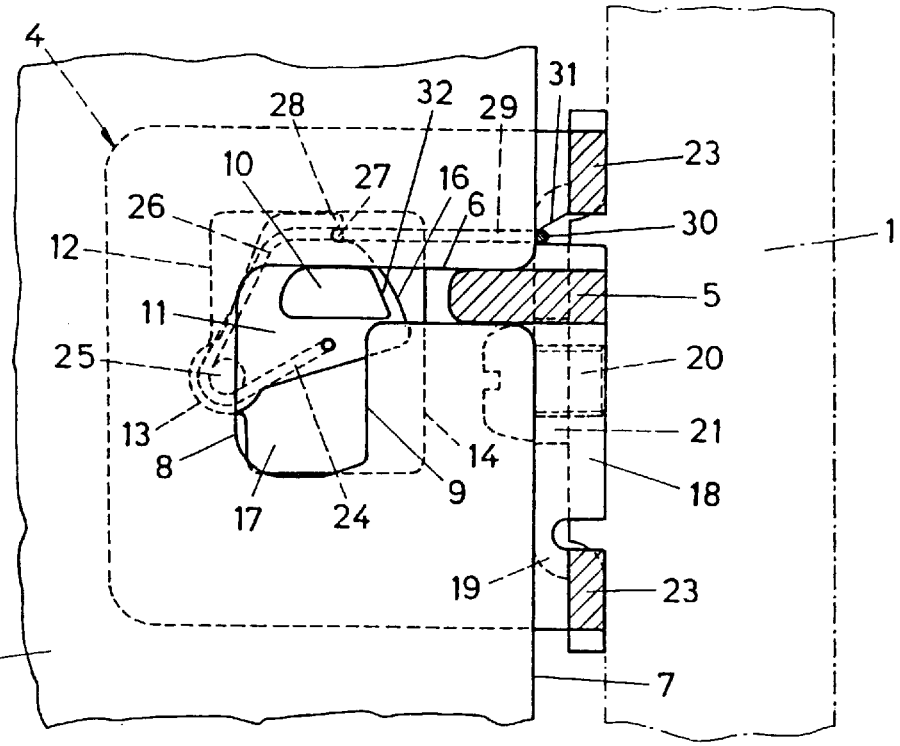

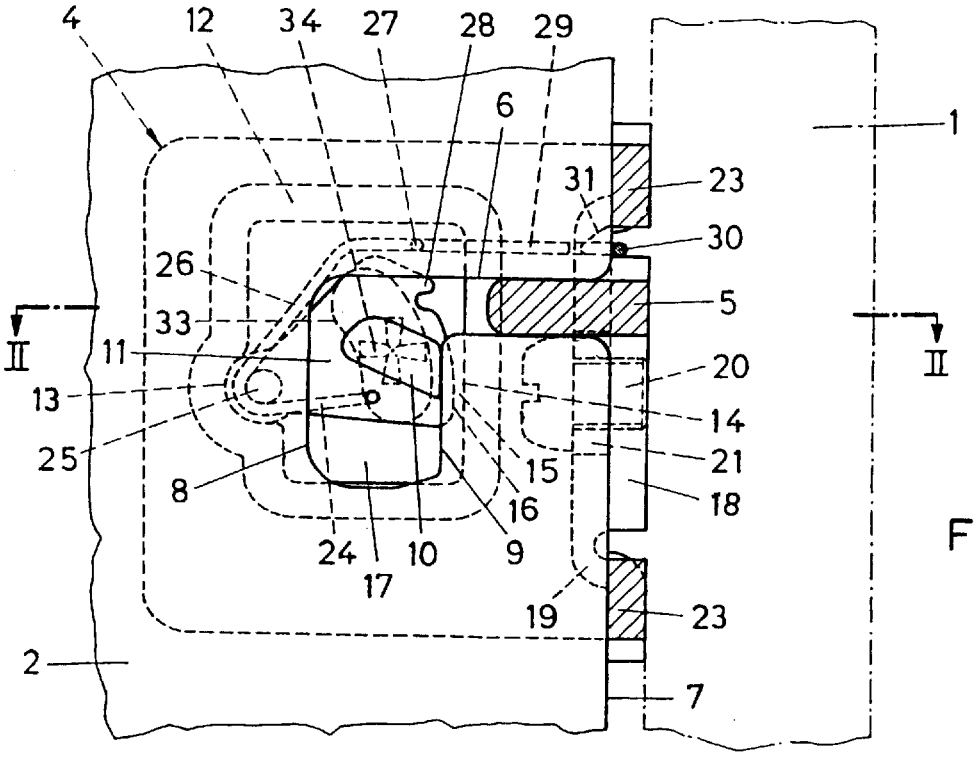
FIG.1
FIG.2
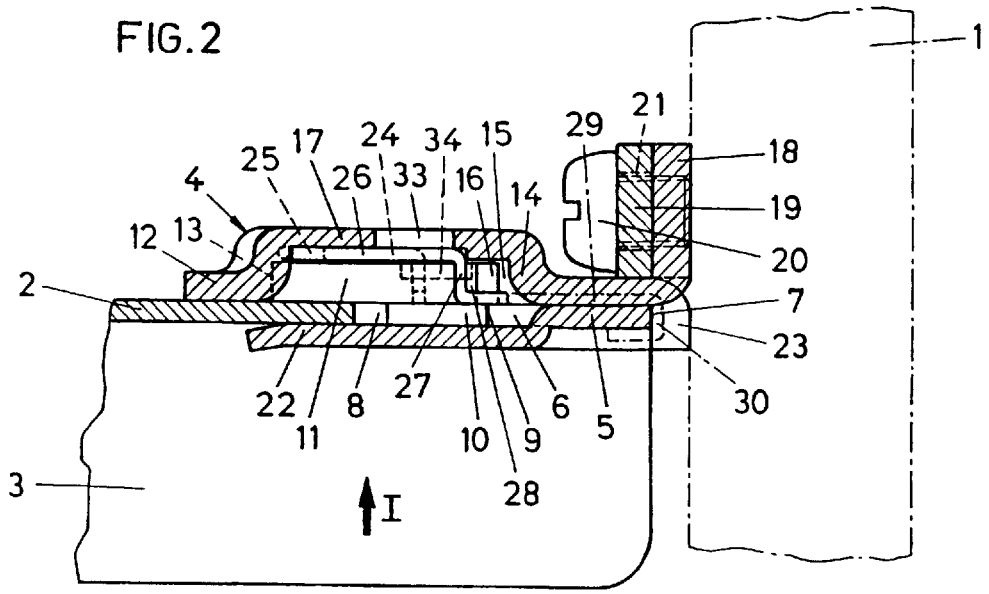

DEVICE FOR MOUNTING THE FRONT PANEL OF A DRAWER

This invention relates to a device in accordance with the generic part of claim 1.

For mounting the front panel of a drawer on a lateral metallic frame of the drawer it is known (AT 391,253 B), for instance, to provide the frame with a slot that is open at the end face for receiving the clamping screw of a holder protruding from the front panel towards the frame. Into this receiving slot, which after an inlet portion extending in longitudinal direction of the frame forms a receiving portion extending transverse thereto, the front panel is hung by means of the clamping screw extending transverse to the receiving slot and connecting the holder with a pressure plate on the opposite side of the frame. For the vertical adjustment of the front panel the holder protruding against the frame is provided with an eccentric which is supported on a strap bent out of the frame. Upon adjustment of the desired vertical position of the front panel by means of this eccentric, the clamping screw is tightened and the frame is clamped between the holder and the opposite pressure plate. The disadvantage of this known construction chiefly consists in that for mounting the front panel on the frame a clamping screw must be tightened by means of a tool. In addition, hanging the holder of the front panel into the receiving slot for the clamping screw after an insertion in longitudinal direction of the frame requires a hanging movement directed transverse thereto, which involves a corresponding requirement of space, which for instance in the case of stored stacks of drawers lying directly one above the other can hardly be provided.

In another known device for mounting the front panel on a metallic frame (EP 0 289 866 A1), the frame is provided with a guiding slot extending in longitudinal direction of the frame for a guiding member which is associated to the holder of the front panel and on a projection protruding beyond the guiding slot on the side of the frame has a locking piece which engages into a locking slot extending transverse to the guiding slot, so that this locking slot forms a locking stop for the locking projection. Upon engagement of the locking piece into the locking slot, the guiding member can therefore no longer be withdrawn from the guiding slot. Since the holder is held at the front panel so as to be merely vertically adjustable with respect to the guiding member, but not movable in longitudinal direction of the frame, the front panel is fixed by means of this guiding member so as to be vertically adjustable, where the parts of the holder surrounding the guiding member on both sides must, however, be urged against each other by means of a clamping screw.

It is finally known (EP 0 761 130 A2) to provide the front panel with a holder for a strap-like projection which can be inserted into a recess of a housing associated to the frame. As this housing has a swivel bar, which is loaded by a compression spring and engages behind the strap-like projection of the front panel, this swivel bar constitutes a locking stop for the projection, which can thus no longer be withdrawn from the housing. The front panel can therefore be connected with the frame without use of a tool, when said frame is provided with a corresponding locking means. For opening the locking position the swivel bar can be swivelled by means of a tool through a through hole in the frame and in the housing from the locking position into a stop-limited unlocking position, in which the swivel bar releases the strap-like projection of the front panel. What is, however, disadvantageous in this known construction is the fact that the frames must be provided with a separate locking means. Moreover, the housing has a comparatively large depth vertical to the frame surface, so that this housing either impairs the clear width of the drawer or requires a corresponding distance between the frames and the lateral body walls of the furniture accommodating the drawer.

It is therefore the object underlying the invention to design a device for mounting the front panel of a drawer on a lateral metallic frame of the drawer as described above such that there is not only ensured an automatic locking of the front panel with respect to the frame without use of a tool, but there can also be avoided an additional means on the frame.

This object is solved by the invention by means of the features in accordance with claim 1.

Since the locking piece represents a constructional element separate from the guiding member, which locking piece constitutes a locking bar subjected to a locking force and, when mounting the front panel on the frame, is inserted through the guiding slot up to its widened portion, the locking piece reaching the widened portion of the guiding slot is moved behind the locking stop formed by the widened portion of the guiding slot as a result of the application of a corresponding locking force, so that the guiding member guided in the guiding slot can no longer be withdrawn from the guiding slot. The locking bar must be disposed laterally beside the frame in the holder for the front panel, where the locking piece protrudes against the frame, so as to engage in the guiding slot or the widened portion thereof. Additionally clamping the holder to the frame is not necessary, if it is ensured that the holder cannot be lifted off the frame vertical thereto, which can already be achieved in that the front panel is fixed at two lateral frames of the drawer by means of symmetrical holders. Although the locking bar carrying the locking piece may constitute a sliding member movably supported transverse to the guiding slot, particularly simple constructional conditions are obtained when the locking bar is formed in accordance with claim 2.

Acting upon the locking bar to achieve an automatic locking may be effected by a weight moment, but there is preferred an embodiment in accordance with claim 3. Acting upon the locking bar with a force required for the automatic locking makes the handling during the insertion of the locking piece into the guiding slot more difficult, since the locking piece must be moved against the force acting on the locking bar into an unlocking position. To secure this unlocking position for the insertion of the locking piece into the guiding slot of the frame, the holder may be designed in accordance with claim 4. When upon insertion of the locking piece into the guiding slot of the frame the detent latch or a constructional element connected therewith gets into the vicinity of the frame stop, the detent latch is released via this frame stop, so that the locking bar is released and the locking piece is moved into the locking position upon reaching the widened portion of the guiding slot. Spring loading the detent latch aids in securing the unlocking position.

Although different constructive solutions are possible for the detent latch, particularly simple constructional conditions can be created by an embodiment in accordance with claim 5. The frame stop is obtained by the end face of the frame. When the stop of the detent latch abuts against the end face of the frame during the insertion of the holder for the front panel into the guiding slot of the frame, the detent latch is retained by the frame with respect to the holder moving on, and the locking nose of the locking bar is released. In the embodiment in accordance with claim 6 the spring clip pulls the detent latch into the locking position, in which the detent latch engages behind the locking nose of the locking bar. The common spring clip can of course also be replaced by two separate springs for acting upon the locking bar on the one hand and for acting upon the detent latch on the other hand.

In the construction in accordance with claim 7 there is achieved a clearance-free locking for the holder, because the locking piece is swivelled against the locking stop, since it is acted upon until close abutment. A loosening thereof as a result of vibrations is also prevented.

Due to the housing formed in accordance with claim 8 the formation of a bearing axis for the swivel bar can be omitted, which swivel bar is pivotally supported in the open bearing shell of the housing and due to the tangential extension of the opposite wall with respect to the swivel bar cannot radially emerge from this bearing shell. In axial direction, the swivel bar is fixed between the frame and the housing bottom opposite the frame. To cover the guiding slot and its widened portion on the side of the frame opposite this housing, an embodiment in accordance with claim 9 may be chosen, which not only provides for a simple construction of the holder, but also a large-surface support of the holder on the frame.

After an automatic locking, the holder for the front panel can only be removed from the frame when the locking piece is swivelled into the unlocking position against the active locking moment, so that the locking piece released by the locking stop can be withdrawn from the guiding slot of the frame. The required swivelling or displacement of the locking bar can, however, only be effected by means of an appropriate tool, which must be attached at the locking bar. For this purpose, the locking bar may be designed in accordance with claim 10. In contrast to the attachment of the front panel at the drawer frames, the removal of the front panel should not be easily possible, so that the use of tools required for this purpose is not regarded as disadvantageous.

To avoid that the locking bar must be retained in the unlocking position of the locking piece by means of a tool for the adjustment of the locking bar against the locking force and at the same time the holder must be removed from the frame, a detent latch may be provided, which must, however, be released again when the holder is mounted on the frame.

An embodiment where the provision of a detent latch for the unlocking position of the locking piece is superfluous and the removal of the front panel from the frame is facilitated is indicated in claim 11.

Due to its movable support, the locking member is fixed in the holder in longitudinal direction of the frame, so that the holder can be adjusted with respect to the frame in longitudinal direction of the frame, when the locking piece is moved during its displacement along an inclined stopping face on the side of the frame. The recess for the locking piece on the side of the guiding slot opposite the widened portion for the locking stop constitutes such stopping face for the locking piece, so that during the adjustment of the locking piece against the locking force it is due to the chosen inclination of this stopping face that the locking piece is not only moved out of the area of the locking stop of the frame, but is also moved along the stopping face towards the inlet end of the guiding slot. This additional component of movement in longitudinal direction of the frame is only possible when the recess is offset with respect to the locking stop in direction of the guiding slot towards the inlet end thereof, which leads to the fact that upon release of the locking piece the same is urged under the influence of the locking force against the protruding edge of the guiding slot, which leads to the widened portion of the locking stop, without engaging behind the locking stop. This provides a self-retaining unlocking, where in addition the front panel is put away from the frame to the extent of the displacement of the locking piece along the stopping face in longitudinal direction of the frame, which considerably facilitates the handling during the removal of the front panel. Upon withdrawal from the frame, the locking piece is moved under the influence of the locking force into a locking position, but this locking position has no importance during the insertion of the holder into the frame, because the locking piece must first be inserted into the guiding slot, before the subsequent guiding member can engage into the guiding slot, which is easily achieved by means of a corresponding vertical adjustment of the front panel and a related movement of the locking piece into the unlocking position.

To be able to sufficiently move the movably mounted locking piece out of the vicinity of the locking stop of the frame by means of a tool, there may be provided an embodiment in accordance with claim 12. Supporting the adjusting tool at the inlet opening provides an advantageous application of force at the toothing of the locking bar, which can thus be moved by means of the toothing by rotating the adjusting tool against the force of the loading spring, until the locking piece abuts against the stopping face of the recess on the side of the frame, so that the locking piece and together with the same the holder is moved inside the guiding slot towards the inlet end.

In accordance with claim 13, however, there also exists the possibility of manually moving the locking bar constituting the locking piece against the closing force without use of a tool.

An embodiment in accordance with claim 14 provides a simple construction for the support of the locking piece in the holder and in addition the possibility of vertically adjusting the front panel with respect to the frame, because the housing is vertically fixed with respect to the frame by means of the guiding member engaging in the guiding slot of the frame, so that an adjustability of the mounting flange of the front panel transverse to the guiding slot necessarily involves the adjustment of the vertical position of the front panel. In terms of construction and handling, this vertical adjustment can be designed particularly advantageously in accordance with claim 14. The adjusting eccentric provides for the adjustment of the vertical position of the mounting flange with respect to the housing, where the support of the adjusting eccentric on the clamping screw associated to the housing is particularly easy. The oblong hole in the angled web of the mounting flange, which extends transverse to the guiding slot, is necessary for the adjusting movement of the mounting flange and at the same time provides for the fixation of the adjusted vertical position by means of the clamping screw, which clamps the angled web of the mounting flange against the housing.

Figure 4:
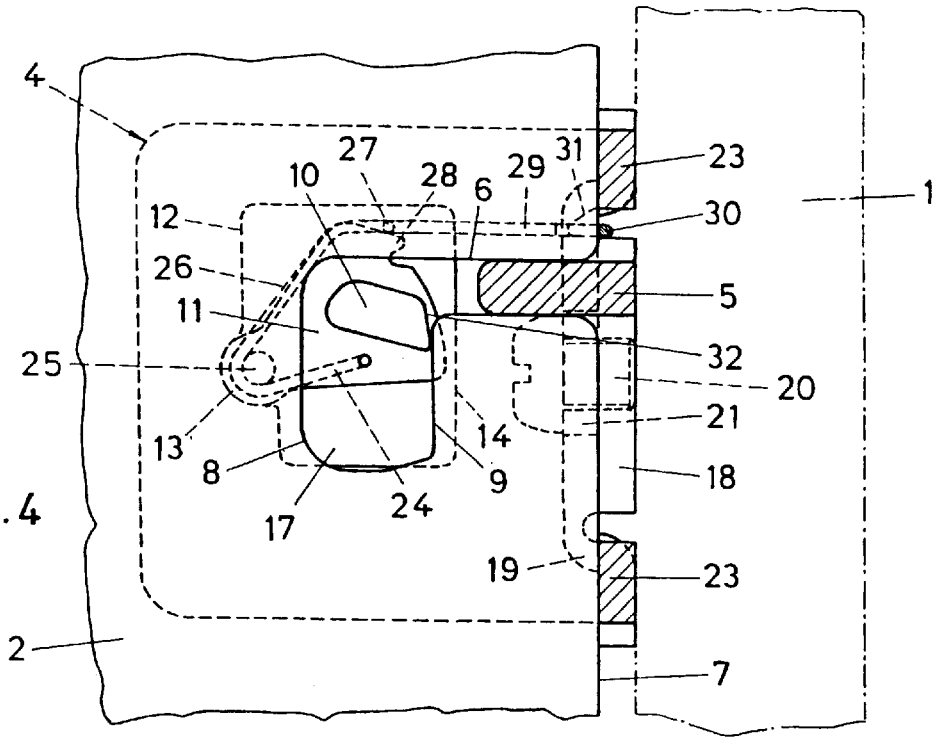
Figure 6:
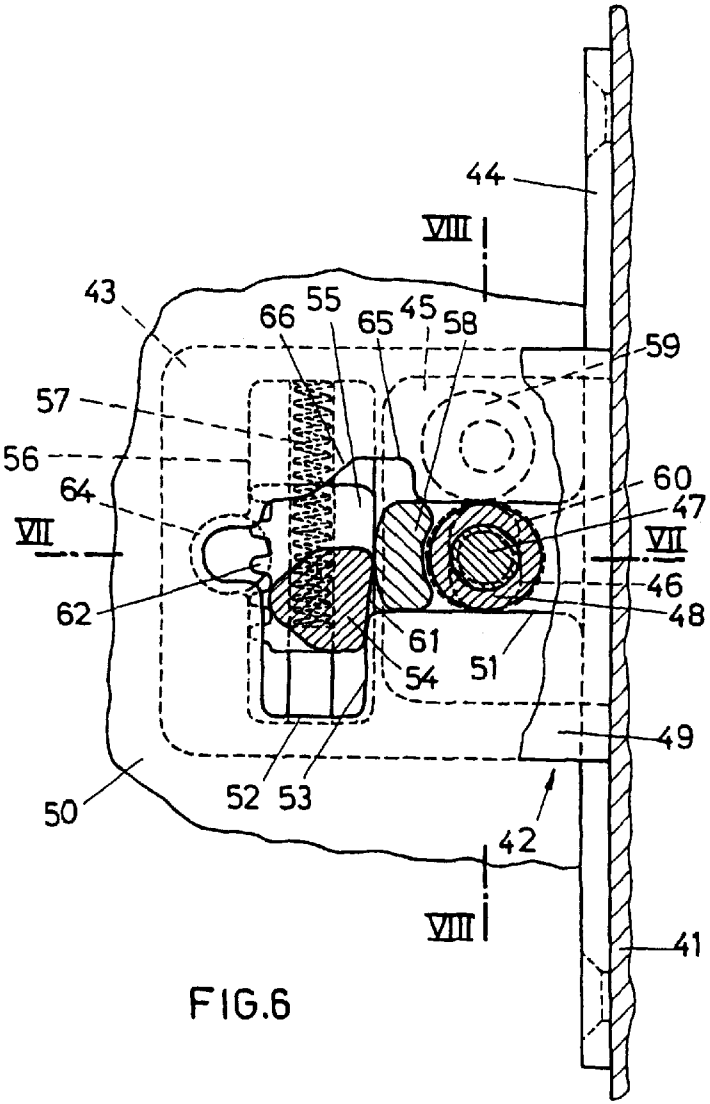
Figure 5:
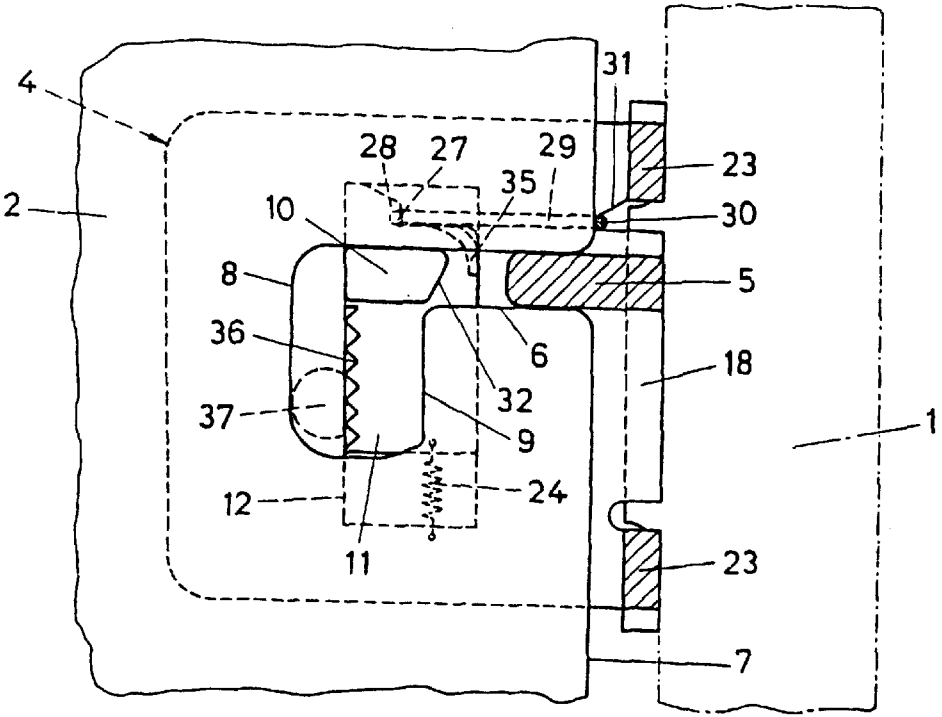
Figure 7:
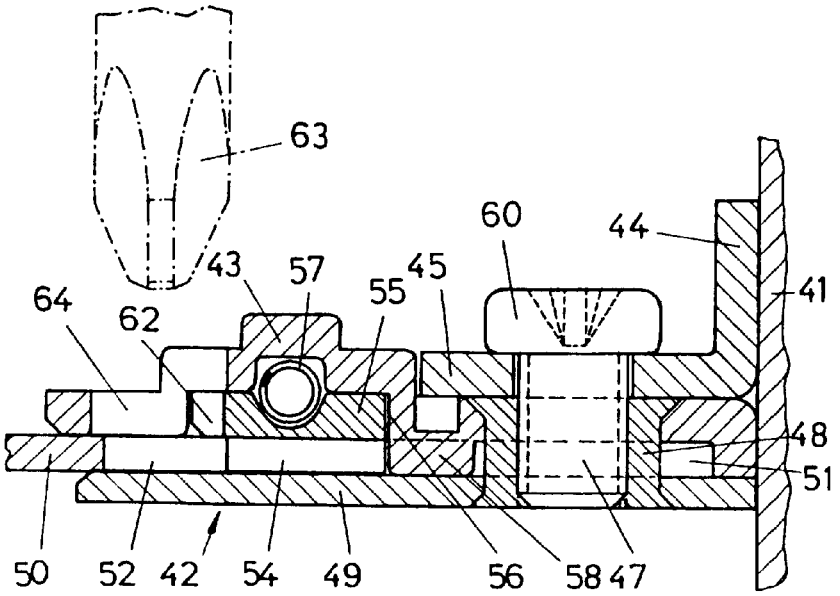
Figure 8:
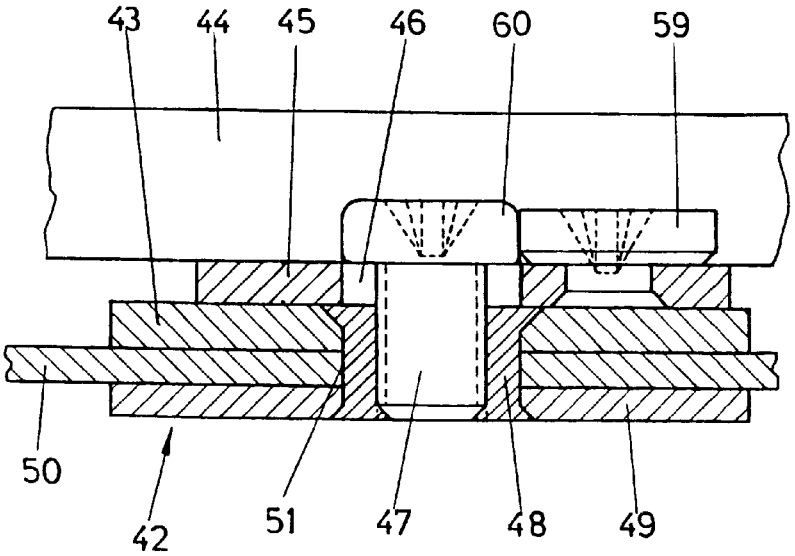
Figure 10:
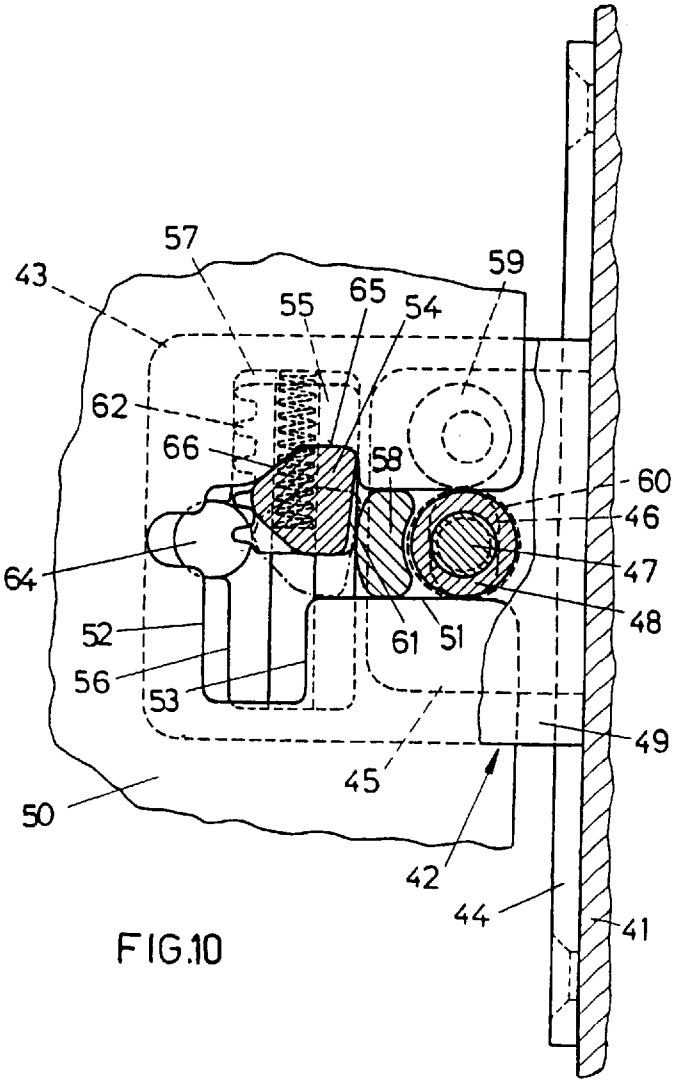
Figure 9:
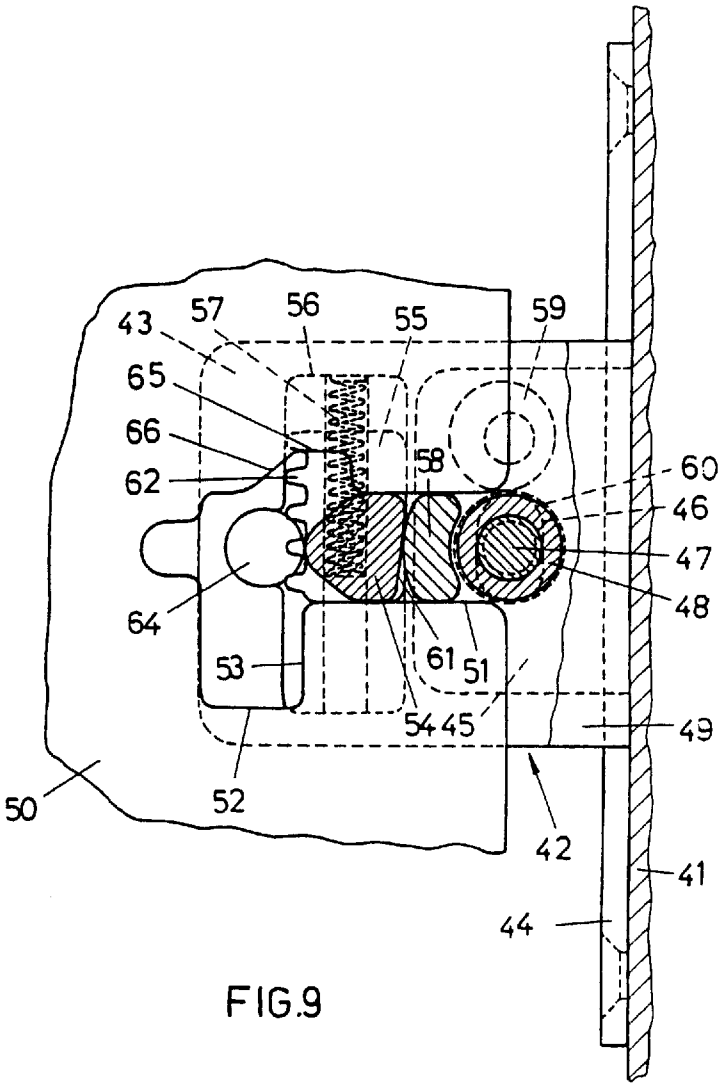

In the drawing, the subject-matter of the invention is represented by way of example, wherein:

FIG. 1 shows an inventive device for mounting the front panel of a drawer on a drawer frame in a side view of the frame in the direction of the arrow I of FIG. 2 with the housing cover removed, FIG. 2 shows a section along line II—II of FIG. 1, FIGS. 3 and 4 show representations corresponding to FIG. 1 of an inventive device in various insertion positions of the holder, FIG. 5 shows a representation corresponding to FIG. 3 of a constructional variant of a device in accordance with the invention, FIG. 6 shows a further device in accordance with the invention in a partly elevational side view, FIG. 7 shows the device in accordance with FIG. 6 in a section along line VII—VII of FIG. 6 on an enlarged scale, FIG. 8 shows a section along line VIII—VIII of FIG. 6, likewise on an enlarged scale, and FIGS. 9 and 10 show the device in various assembly positions in a representation corresponding to FIG. 6.

The device represented in FIGS. 1 to 5 for mounting the front panel 1 of a drawer on a lateral metallic frame 2, which on its upper longitudinal edge conventionally has an outwardly angled web for the roller of a pull-out means and on its lower longitudinal edge an inwardly angled flange 3 for fixing a drawer bottom, substantially consists of a holder 4 provided on the front panel 1 and protruding against the frame 2, where a guiding member 5 of the holder engages in a guiding slot 6 of the frame 2. This guiding slot 6, which extends in longitudinal direction of the frame and is open towards the end face 7 of the frame 2, comprises a widened portion 8 extending transverse to the guiding slot 6. The end of the frame recess obtained by the widened portion 8, which is closer to the end face 7, serves as locking stop 9 for a locking piece 10, which is provided on a locking bar 11 disposed laterally beside the frame 2 and from this locking bar 11 laterally protrudes into the widened portion 8. For the locking bar 11 designed as swivel bar the holder 4 forms a housing 12 open towards the frame 2, in which housing the locking bar 11 is pivotally accommodated in an open bearing shell 13. The swivel axis extends vertical to the frame 2. Since the locking bar 11 substantially represents a sector of a circular cylinder, and the housing wall 14 opposite the bearing shell 13 extends tangentially with respect to the cylindrical periphery 16 of the locking bar 11 by leaving a clearance 15, a concrete formation of the swivel axis for the locking bar 11 can be omitted, which is fixed axially between the bottom 17 of the housing 12 and the frame 2 and radially between the bearing shell 13 and the opposite housing wall 14.

Together with a web 18 angled outwards from the frame 2 the holder 4 resting against the outside of the frame 2 forms a mounting flange for the front panel 1, which by means of a clip 19 extending over this angled web 18 can be clamped against the web 18. The clamping screw is designated with 20. Since the clamping screw 20 extends through the clip 19 in a vertical oblong hole 21, the front panel 1 can be vertically offset with respect to the web 18 of the holder 4, so as to subsequently provide for a vertical adjustment of the front panel 1.

On the side of the frame 2 opposite the housing 12 a cover 22 associated to the holder is provided for the guiding slot 6 and the widened portion 8 thereof. This cover 22 comprises a projection engaging in the guiding slot 6, which is for instance formed by a bulge, which constitutes the guiding member 5 and is rigidly connected with the holder 4 via the cover 22, as can be taken from FIG. 2. For additionally supporting the holder 4 on the end face 7 of the frame 2, the holder may comprise two inwardly angled webs 23 laterally beside the middle web 18, which webs 23 extend over the end face 7 of the frame 2 and are connected with the cover 22.

The locking bar 11 is acted upon by a spring 24, which is guided around a deflection lug 25 of the locking bar 11 and applies a locking moment onto the locking bar 11 in the locking sense of the locking piece 10. This spring 24 is formed by a spring clip 26, which together with an angled transverse web forms a detent latch 27 cooperating with a locking nose 28 of the locking bar 11. By means of an extension 29 of the spring clip 26 this detent latch 27 is guided in the holder 4 so as to be movable in longitudinal direction of the frame 2 and on its end protruding from the holder 4 has a stopping web 30 enclosing the end face 7 of the frame 2.

By means of the detent latch 27 the locking bar 11 is held in a stop-limited unlocking position, as this is represented in FIG. 3. The stopping web 30 is supported at the bottom of a guiding groove 31 of the holder 4. In the unlocking position of the locking bar 11 the locking piece 10 is disposed before the locking member 5 in the direction of the guiding slot 6, so that the holder 4 is inserted into the guiding slot 6 first with the locking piece 10 and then with the guiding member 5, until the stopping web 30 of the prolonged spring clip 26 abuts against the end face 7 of the frame 2. When the holder 4 is now inserted further into the guiding slot 6 from this position indicated in FIG. 3, the detent latch 27 is retained by the stopping web 30 with respect to the locking bar 11 moving on together with the holder 4, so that the detent latch 27 releases the locking nose 28 of the locking bar 11, and since the locking bar 11 is acted upon by the spring 24, the locking piece 10 swivels into the widened portion 8, as can be taken from FIG. 4. The locking piece 10 engages behind the locking stop 9, so that a withdrawal of the holder 4 from the guiding slot 6 is effectively prevented.

In peripheral direction, the supporting surface 32 of the locking piece 10, which cooperates with the locking stop 9, has a distance from the swivel axis of the locking bar 11 defined by the bearing shell 13, which increases with increasing angle of engagement of the locking piece 10 into the widened portion 8. This means that with increasing angle of engagement the holder 4 is more firmly drawn into the guiding slot 6 by means of the locking piece 10 and therefore rests against the end face 7 of the frame 2 without a clearance. By means of the locking piece 10 there is thus achieved a safe attachment of the front panel 1 on the frame 2, which is not susceptible to vibrations, and without having to additionally tighten a clamping screw or the like.

For removing the front panel 1 from the frame 2, the locking bar 11 must be swivelled from the locking position represented in FIG. 1 against the force of the spring 24 into the unlocking position. This can only be achieved by means of a tool, which can be attached at the locking bar 11 through a through hole 33 in the bottom of the housing 17, for which purpose the locking bar has a corresponding recess 34 for the attachment of the tool, for instance in the form of a cross recession. By means of a corresponding screw driver the locking bar 11 can therefore be rotated into the unlocking position, and the locking piece 10 can then be withdrawn from the frame 2 through the guiding slot 6.

The embodiment in accordance with FIG. 5 merely differs from that in accordance with FIGS. 1 to 4 in that the locking bar 11 is not designed as swivel bar, but as sliding member, which is movably supported in the housing 12 transverse to the guiding slot 6. In this case, the spring 24 is provided separate from the spring 35 for acting upon the detent latch 27. This spring 35 is formed by a correspondingly angled leg of the detent latch 27 formed by a spring clip. When the stopping web 30 abuts against the end face 7 of the frame 2, the detent latch 27 is again retained with respect to the locking bar 11 moving on together with the holder 4, which leads to a release of the locking bar 11 and thus an engagement of the locking piece 10 into the widened portion 8, as this has already been explained in conjunction with FIGS. 1 to 4. For unlocking purposes, the locking bar 11 must be moved into the unlocking position by means of a screw driver, which cooperates with a toothing 36 of the locking bar 11 and is supported in a housing aperture 37, against the force of the spring 24.

According to FIGS. 6 to 10, a holder 42 to be screwed onto a front panel 41 consists of a housing 43 and a mounting flange 44 for the front panel 41, which mounting flange is movably mounted on the housing 43 with an angled web 45. For this purpose, the web 45 has an oblong hole 46 for the passage of a clamping screw 47, which threadingly engages in a threaded bushing 48 riveted into the housing 43. As can be taken in particular from FIGS. 7 and 8, the threaded bushing 48 extends through the housing 43, which has a cover plate 49, between which and the housing 43 a receiving gap for the metallic frame 50 is provided. The frame 50, at which the front panel 41 must be attached by means of the holder 42, has a guiding slot 51 extending in longitudinal direction of the frame and open on the front side, which slot has a widened portion 52 aligned transverse to the longitudinal direction of the frame, so as to obtain by means of this widened portion 52 a locking stop 53 for a locking piece 54, which is provided on a locking bar 55 constituting a sliding member. This locking bar 55 is disposed in a sliding guide 56 of the housing 43 laterally beside the frame 50 and is acted upon by a helical spring 57 in the locking sense of the locking piece 54. The housing 43 of the holder 42 in addition comprises a guiding member 58 engaging in the guiding slot 51, which guiding member together with the threaded bushing 48 likewise extending through the guiding slot 51 vertically fixes the holder 42 with respect to the frame 50. For vertically adjusting the front panel 41 an adjusting eccentric 59 is mounted on the angled web of the mounting flange 44, which eccentric is supported on the head 60 of the clamping screw 47, so that with loosened clamping screw 47 the vertical adjustment of the front panel 41 can be effected by means of the adjusting eccentric 59. The oblong hole 46 in the web 45 provides for the necessary relative displacement of the web 45 with respect to the housing 43. Upon tightening the clamping screw 47, the adjusted vertical position of the front panel 41 is fixed.

For mounting the front panel 41 on the frame 50, the front panel 41 must first be inserted in the receiving gap between the housing 43 and the cover plate 49, so that the locking piece 54 engages in the guiding slot 51. Since the locking bar 55 is urged by the helical spring 57 into the lower stop position, the insertion of the guiding member 58 into the guiding slot 51 is effected by pressing downwards the front panel 41 with the holder 42, where due to the locking piece 54 supported in the guiding slot 51 the locking bar 55 is moved upwards, until the guiding member 58 can be inserted into the guiding slot 51, as this is represented in FIG. 9. For locking the holder 42 with the frame 50 it is merely necessary to move the front panel 41 with the holder 42 against the frame 50 in longitudinal direction of the frame, until the locking piece 54 has reached the widened portion 52 of the guiding slot 51 and as a result of the load applied by the helical spring 57 slides behind the locking stop 53, as this is shown in FIG. 6. Since the stopping face 61 of the locking piece 54 cooperating with the locking stop 53 forms an inclined stopping face, a clearance-free locking of the holder 42 with respect to the frame 50 is achieved upon insertion of the locking piece 54 into the widened portion 52. In this locking position, the vertical adjustment of the front panel 41 by means of the adjusting eccentric 59 can be effected as described above.

For releasing the locking, the locking bar 55 must be moved upwards against the force of the helical spring 57. For this purpose, the locking bar 55 has a toothing 62 on the end face facing away from the inlet slot 61, in which toothing an adjusting tool 63 (FIG. 7), for instance a screw driver, can be inserted, namely via an inlet opening 64 in the housing 43. This inlet opening 64 constitutes a pivot bearing for the adjusting tool 63, so that by means of a rotary adjustment of the adjusting tool 63 the locking bar 55 can be raised above its toothing 61 in the sliding guide 56.

On the side opposite the widened portion 52 the guiding slot 51 opens towards a recess 65 for the locking piece 54, which during the unlocking movement is urged against a stopping face 66, which is inclined back against the guiding slot 51, so that the locking piece 54 is additionally moved towards the guiding slot 51 along the stopping face 66, as this is illustrated in FIG. 10. This transverse movement of the locking piece 54 inside the recess 65 of the guiding slot 51 is possible because the recess 65 is positioned backwards with respect to the widened portion 52 and thus with respect to the locking stop 53. Unlocking the locking piece 54 thus involves a movement of the holder 42 in opening direction, which in turn ensures that upon withdrawal of the adjusting tool 63 the locking piece 54 can no longer be moved into the locking position, but is supported in the guiding slot 51, as this is illustrated by the dash-dotted position of the locking piece 54. The holder 42 can therefore be withdrawn from the frame 50 without further use of a tool.

What is claimed:

1. A drawer comprising a lateral metallic frame having an end face and extending in a longitudinal direction, a front panel and a device for mounting the front panel on the lateral metallic frame, the mounting device comprising a holder provided at the front panel and protruding against the lateral metallic frame, the holder comprising (a) a guiding member engaging in a guiding slot of the frame, the guiding slot being open at the end face, extending in the longitudinal direction and forming a widened portion constituted by a frame recess extending transversely to the longitudinal direction, (b) a locking piece disposed at a side of the guiding member facing away from the front panel, (1) the frame recess forming a locking stop engaged by a supporting surface of the locking piece, (c) a locking bar insertable through the guiding slot into the widened portion laterally adjacent the frame, the locking bar being a carrier for the locking piece and being movable transversely to the guiding slot, and (d) means for subjecting the locking bar to a locking force.

2. The drawer of claim 1, wherein the locking bar is a swivel bar having a swivel axis extending vertically to the frame.

3. The drawer of claim 1, wherein the means for subjecting the locking bar to a locking force is a spring.

4. The drawer of claim 1, wherein the holder further comprises a spring-loaded detent latch holding the locking bar in an unlocked position, and the frame has a stop for releasing the locking bar into a locked position.

5. The drawer of claim 4, wherein the locking bar has a locking nose cooperating with the detent latch, and the detent latch is supported in the holder for movement in the longitudinal direction and has a stopping web extending over the end face of the frame.

6. The drawer of claim 5, wherein the locking bar is a swivel bar having a swivel axis extending vertically to the frame, the means for subjecting the locking bar to a locking force is a spring, and the detent latch and the spring form a common spring clip.

7. The drawer of claim 1, wherein the locking bar is a swivel bar having a swivel axis extending vertically to the frame, and the supporting surface of the locking piece has a distance from the swivel axis of the locking bar which increases in a peripheral direction with an increasing angle of engagement of the locking piece with the frame recess.

8. The drawer of claim 7, herein the holder forms a housing defining an open bearing shell for the swivel bar, the housing being open towards the frame and having a wall opposite the bearing shell and tangentially adjoining the swivel bar, the swivel bar having a circular cylindrical shape adjacent the wall, and the wall leaving a clearance.

9. The drawer of claim 1, wherein the holder further comprises a cover for the guiding slot and the widened portion thereof, the cover being arranged on a side of the frame opposite the locking bar and being connected to the holder by the guiding member.

10. The drawer of claim 1, wherein the locking bar has a recess accessible through a through hole in the holder for the attachment of a tool for adjusting the locking bar in a direction opposite the locking force.

11. A drawer comprising a lateral metallic frame having an end face and extending in a longitudinal direction, a front panel and a device for mounting the front panel on the lateral metallic frame, the mounting device comprising a holder provided at the front panel and protruding against the lateral metallic frame, the holder comprising (a) a guiding member engaging in a guiding slot of the frame, the guiding slot being open at the end face, extending in the longitudinal direction and forming a widened portion constituted by a frame recess extending transversely to the longitudinal direction, (b) a locking piece disposed at a side of the guiding member facing away from the front panel, (1) the frame recess forming a locking stop engaged by a supporting surface of the locking piece, (2) the widened portion opening on a side of the guiding slot opposite the locking stop towards a recess and the locking piece being movably supported in the recess, and (3) the recess having a stopping surface inclined back against the guiding slot for the locking piece and offset with respect to the locking stop in the longitudinal direction towards an inlet thereof, (c) a locking bar insertable through the guiding slot into the widened portion laterally adjacent the frame, the locking bar being a carrier for the locking piece and being movable transversely to the guiding slot, and (d) means for subjecting the locking bar to a locking force.

12. The drawer of claim 11, wherein the locking bar is a spring-loaded sliding element having a toothing on an end face extending transversely to the guiding slot, the toothing extending tangentially with respect to an inlet opening for an adjusting tool provided in the holder, the tool engaging the toothing and being supported in the inlet opening.

13. The drawer of claim 11, wherein the holder comprises a housing constituting a sliding guide for the locking bar and a mounting flange for the front panel, the mounting flange being movable with respect to the housing transversely to the guiding slot and being fixable in a desired sliding position.

14. The drawer of claim 13, wherein the mounting flange has an angled web defining an oblong hole extending transversely to the guiding slot, and further comprising clamping screw having a head and screwed into the housing adjacent the guiding member, and an adjusting eccentric supported on the screw head and extending in the direction of the oblong hole.

* * * * *